US009583882B1

(12) United States Patent
Hsueh

(10) Patent No.: US 9,583,882 B1
(45) Date of Patent: Feb. 28, 2017

(54) ELECTRICAL CONNECTOR

(71) Applicant: SPEED TECH CORP., Taoyuan (TW)

(72) Inventor: Cheng-Hsiang Hsueh, Taoyuan (TW)

(73) Assignee: SPEED TECH CORP., Taoyuan (TW)

( * ) Notice: Subject to any disclaimer, the term of this patent is extended or adjusted under 35 U.S.C. 154(b) by 0 days.

(21) Appl. No.: 15/226,926

(22) Filed: Aug. 3, 2016

(51) Int. Cl.

| | |
|---|---|
| ***H01R 12/00*** | (2006.01) |
| ***H01R 13/6471*** | (2011.01) |
| ***H01R 13/6581*** | (2011.01) |
| ***H01R 24/64*** | (2011.01) |
| ***H01R 13/41*** | (2006.01) |
| *H01R 107/00* | (2006.01) |

(52) U.S. Cl.
CPC ..... *H01R 13/6471* (2013.01); *H01R 13/41* (2013.01); *H01R 13/6581* (2013.01); *H01R 24/64* (2013.01); *H01R 2107/00* (2013.01)

(58) Field of Classification Search
CPC H01R 23/722; H01R 9/0735; H01R 23/6806; H01R 23/682
USPC ..... 439/66, 67, 71, 326
See application file for complete search history.

(56) References Cited

U.S. PATENT DOCUMENTS

| | | | | |
|---|---|---|---|---|
| 5,993,263 | A * | 11/1999 | Sampson | H01R 13/193 439/660 |
| 7,320,623 | B2 * | 1/2008 | Hisamatsu | H01R 12/721 439/108 |
| 9,407,022 | B1 * | 8/2016 | Wang | H01R 12/91 |
| 9,461,413 | B2 * | 10/2016 | Duan | H01R 13/6594 |
| 2009/0221165 | A1 * | 9/2009 | Buck | H01R 13/514 439/108 |
| 2013/0149882 | A1 | 6/2013 | Luo et al. | |

* cited by examiner

*Primary Examiner* — Phuongchi T Nguyen
(74) *Attorney, Agent, or Firm* — CKC & Partners Co., Ltd.

(57) ABSTRACT

An electrical connector includes an insulator, a plurality of conducting terminals, and a ground member. The insulator includes an insulating body and a tongue portion extending from one side of the insulating body. The conducting terminals include a plurality of ground terminals and a plurality of signal terminals alternatively arranged. The ground terminals and the signal terminals include a contacting portion, a tail portion, and a main portion. The ground member includes a conducting body and a plurality of extension portions. At least one side of each of the extension portions includes a restriction portion. The main portion of the ground terminals is stacked with each of the extension portions, and contact with restriction portion. The ground member and the main portions are fixed within the insulating body. The contacting portions are arranged on the surface of the tongue portion. The tail portion extends out of the insulating body.

6 Claims, 11 Drawing Sheets

ELECTRICAL CONNECTOR

CROSS-REFERENCE TO RELATED APPLICATION

This application claims priority to Taiwan Application Serial Number 105206694, filed May 9, 2016, which is herein incorporated by reference.

BACKGROUND

Field of Invention

The present invention relates to an electrical connector. More particularly, the present invention relates to an electrical connector for transmitting high-frequency signal.

Description of Related Art

Due to the highly development of technologies, to provide various transmission requirement, several transmission specifications are introduced, such as the early Small Computer System Interface (SCSI) to the latest Serial Attached SCSI (SAS). For a high speed data access, the serial technologies solve the problem in the traditional parallel technologies, providing further high speed signal transmission. Therefore, the SAS can be support of and compatible with Serial Advanced Technology Attachment (SATA) device, resulting in advantages of wider use.

Under the requirements of high speed transmission and reduced size of electrical connectors, the arrangement between terminals becomes closer, and the signal transmission becomes high-frequency transmission. Therefore, issues such as signal interference are generated when the connector transmits signals. Since the distance between two signal terminals is too close, capacitive and inductive couplings are induced between signal terminals when high-frequency signals are transmitted. The capacitive and inductive couplings lead to the problem of cross talk and noise, thereby affecting the transmission rate and accuracy.

To overcome the problem of cross talk, in conventional technology, a ground terminal is disposed between two signal terminals. The ground terminal can ground the capacitive and inductive noises coupled by the signal terminals, thereby reducing the signal interference. However, such technology for solving cross talk interference still remains a lot to improve.

To improve the problem of cross talk, U.S. Pat. No. 2013/0149882 discloses an electrical connector, as shown in FIG. 11. The electrical connector includes a housing A, a plurality of contacts B and a ground bar C. The housing A is made of insulating material. The contacts B and the ground bar C are disposed in the housing A. The housing A includes a base portion A1 and a tongue portion A2 extended from the base portion A1. The contacts B include a plurality of grounding portions B1 and a plurality of signal contacts (not shown). The grounding portions B1 respectively include a contacting plate B11, a soldering portion B13, and a retaining portion B12 connecting the contacting plate B11 to the soldering portion B13. The contacting plates B11 are arranged on a plane of the tongue portion A2. The retaining portion B12 is disposed in the base portion A1. The ends of the soldering portion B13 respectively extend out of the base portion A1, and the solder portion B13 may be connected to a circuit board (not shown). The arrangement of the contacts B includes one signal contact (not shown) disposed between at least two of the grounding portions B1. The ground bar C includes a plurality of spring fingers C1 and a beam portion C2. The spring fingers C1 extend from the beam portion C2 and are electrically connected to each other. The spring fingers C1 contact the retaining portion B12 of the grounding portions B1 and are disposed in the housing A.

In the prior art, the grounding portions B1 are connected to the spring fingers C1 of the ground bar C, such that the noises induced by the high-frequency transmission signal of the signal contacts (not shown) may be grounded, thereby reducing the problem of cross talk.

However, in the prior art, the grounding portions B1 are connected to the ground bar C through one of the corresponding spring fingers C1, and the contact area between the retaining portion B12 of the grounding portions B1 and the spring fingers C1 is small. When the interference noises are grounded through the grounding portion B1 and the ground bar C, the transmission rate of grounding noises is lower due to the small contact area. Therefore, the problem of high-frequency interference still exists in the electrical connector. Moreover, during the assembling process of spring fingers C1 and the grounding portions B1, the registration yield and the adherence condition are both factors that affect the grounding of interference.

Since that the prior art cannot satisfy the practical requirement of industry, an improvement is needed to overcome the problem.

SUMMARY

An aspect of the present disclosure provides an electrical connector including an insulator, a plurality of conducting terminals, and a ground member. The insulator includes an insulating body and a tongue portion extending from one side of the insulating body. The conducting terminals are formed by alternatively arranging a plurality of ground terminals and a plurality of signal terminals. The ground terminals and the signal terminals respectively include a contacting portion, a tail portion, and a main portion connecting the contacting portion to the tail portion. The ground member includes a conducting body and a plurality of extension portions extending from the conducting body. At least one restriction portion is disposed on at least one side of each of the extension portions. At least part of the main portion of each of the ground terminals is stacked with each of the extension portions and contact with the restriction portion on the side. The ground member and the main portion of each of the ground terminals are fixed within the insulating body. The tail portions extend out of the insulating body, respectively. The contacting portions are disposed on a plurality of surfaces of the tongue portion.

The electrical connector for transmitting high-frequency signals includes a ground member, which can reduce the problem of cross talk interference when a plurality of signal terminals transmit high-frequency signals. The ground member includes a pair of restriction portion and an extension portion. The restriction portion and the extension portion may be used for fixing a plurality of ground terminals and increase the contact area to the ground terminals. Therefore, the interference noise may be grounded rapidly, thereby increasing the transmission yield and transmission rate of the electrical connector.

To further understand the features, characteristics, and technologies of the present disclosure, please refer to the following descriptions and figures of the present disclosure. It is noted that the figures provided are merely used for reference and explanation, and are not intended to be limiting the disclosure.

DETAILED DESCRIPTION

Figure 1:
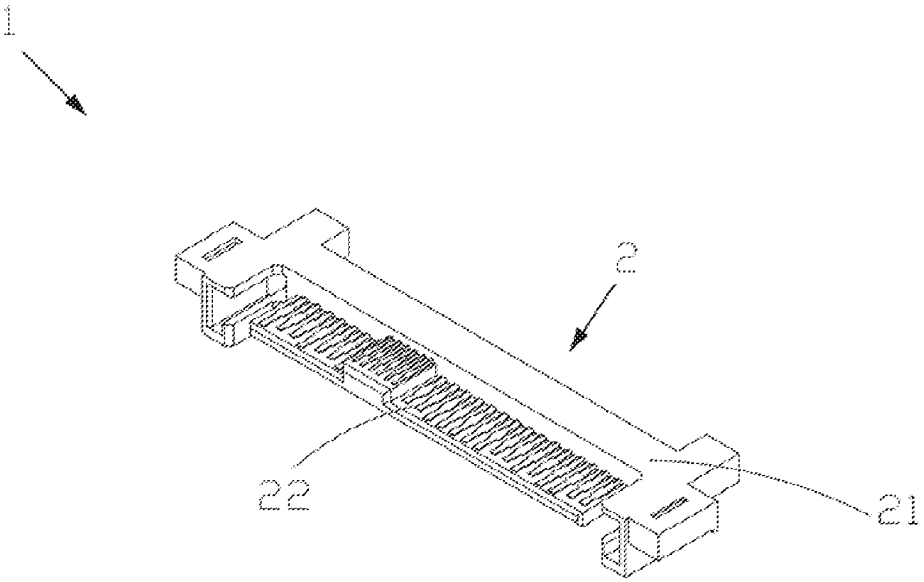
FIG. 1 is a perspective view of an embodiment of an electrical connector according to the present disclosure.
Figure 2:
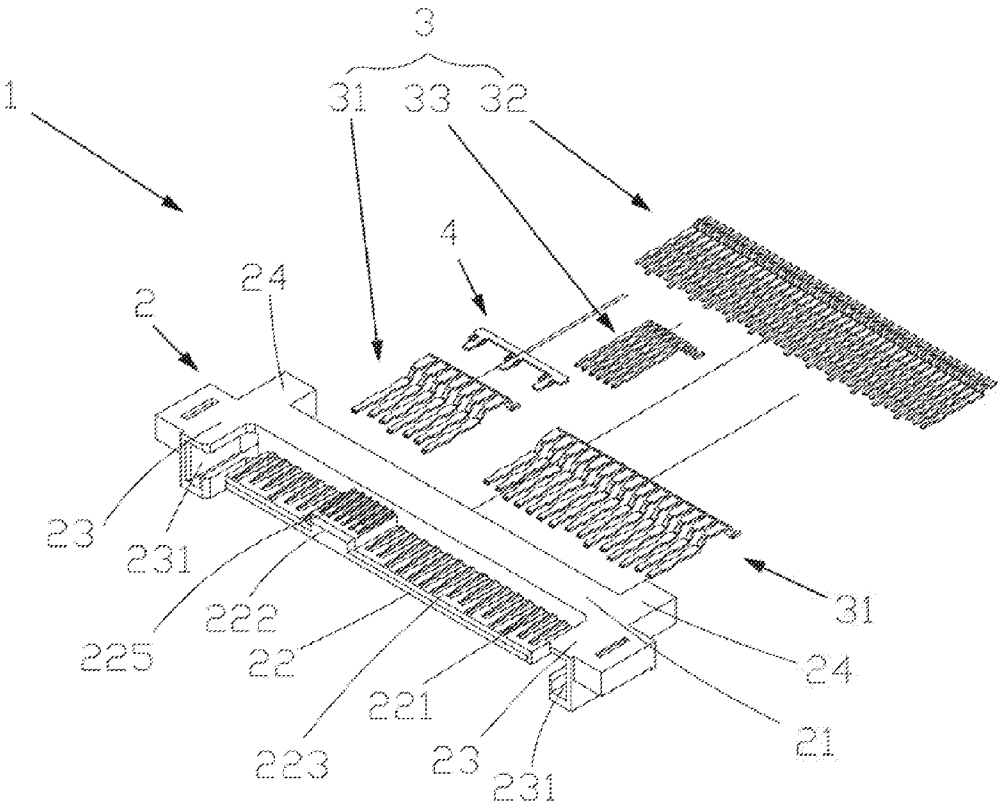
FIG. 2 is an explosion view of an embodiment of an electrical connector according to the present disclosure.
Figure 3:
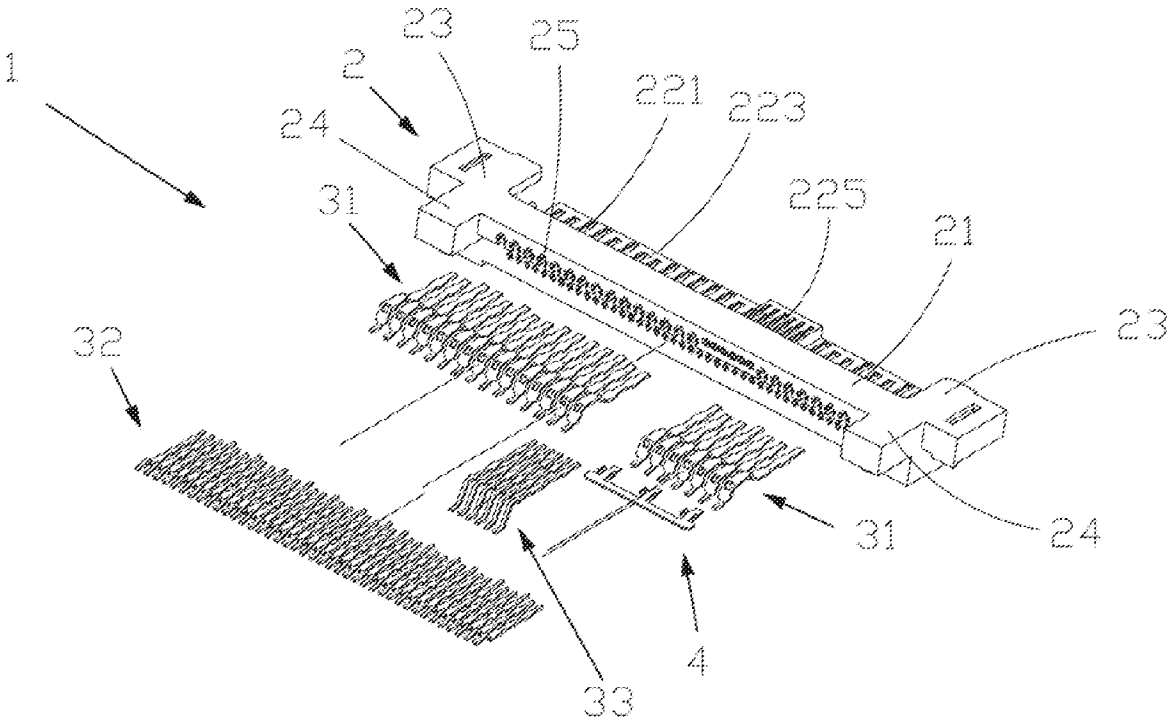
FIG. 3 is another explosion view from different viewpoint of an embodiment of an electrical connector according to the present disclosure.

Reference is made to FIGS. 1 to 3. In the present disclosure, an electrical connector 1 is a transmission device for transmitting high-frequency signals. The electrical connector 1 mainly includes an insulator 2, a plurality of conducting terminals 3, and a ground member 4. The electrical connector 1 may be fixed on a circuit board (not shown), and may be connected with an opposite connectors (not shown).

Figure 4:
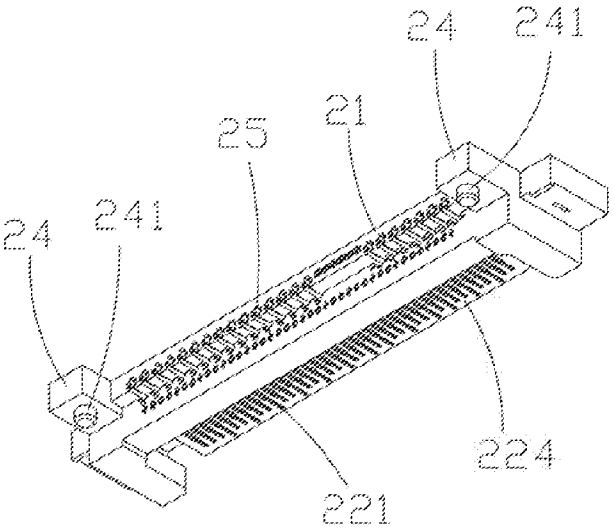
FIG. 4 is a local view of an embodiment of an electrical connector according to the present disclosure.

In the present disclosure, referring to FIGS. 2, 3, and 4, the insulator 2 includes an insulating body 21, a tongue portion 22, and two guiding portions 23. The tongue portion 22 extends from one side of the insulating body 21. The guiding portions 23 are respectively formed on the two opposite sides of the insulating body 21 and extend to the same direction as the tongue portion 22. Each of the guiding portions 23 includes a receiving recess 231 present on the opposite sides of the tongue portion 22. Two projection structures 24 extend from the opposite side of the guiding portions 23 of the insulating body 21. A projection portion 241 is disposed on the bottom of each of the projection structures 24. The projection portions 241 can be engaged to the circuit board (not shown), and the projection portions 241 may be a cylindrical structure. A plurality of slots 25 are disposed on the insulating body 21 and extend from a side away from the tongue portion 22 of the insulating body 21. The slots 25 are arranged in two rows, and penetrate through the insulating body 21. The opposite sides of the tongue portions 22 include a first surface 223 and a second surface 224, respectively. A protrusion portion 222 is disposed at the first surface 223, and the protrusion portion 222 has a third surface 225. The first surface 223, the second surface 224, and the third surface 225 include a plurality of terminal grooves 221, respectively. Each of the terminal grooves 221 is connected to each of the slots 25 of the insulating body 21.

Figure 6:
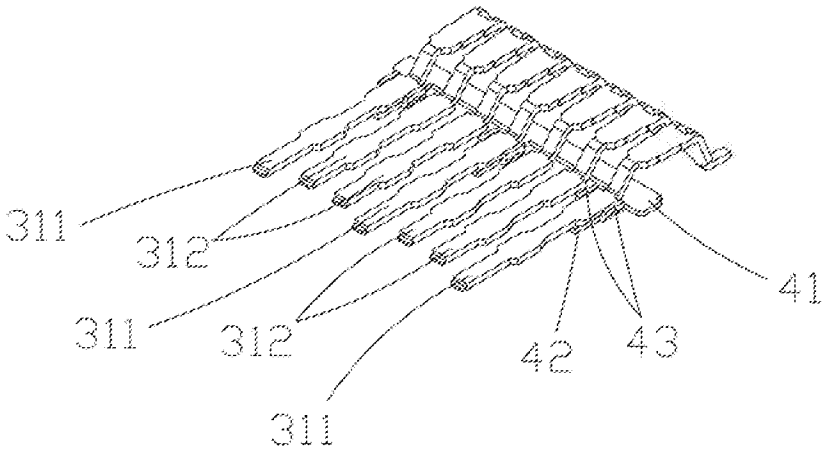
FIG. 6 is a local view of an embodiment of an electrical connector according to the present disclosure.
Figure 7:
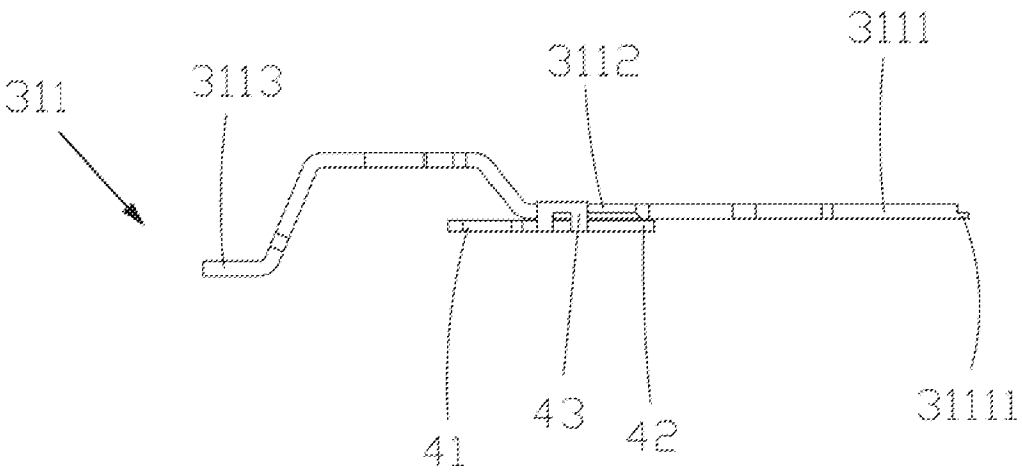
FIG. 7 is a local view of an embodiment of an electrical connector according to the present disclosure.

In the present disclosure, referring to FIGS. 2, 6, and 7, the conducting terminals 3 include a plurality of first terminals 31 disposed on the first surface 223 of the tongue portion 22, a plurality of second terminals 32 disposed on the second surface 224 of the tongue portion 22, and a plurality of third terminals 33 disposed on the third surface 225 of the tongue portion 22. The first terminals 31 include a plurality of first ground terminals 311 arranged on the first surface 223, and a plurality of first signal terminals 312 arranged on the first surface 223. Since the first terminals 31, the second terminals 32, and the third terminals 33 have substantially identical structures, the following description uses first ground terminals 311 as example. The first ground terminals 311 includes a first contacting portion 3111, a first tail portion 3113, and a first main portion 3112, in which the first main portion 3112 connects the first contacting portion 3111 to the first tail portion 3113. The first ground terminals 311 may be inserted into the slots 25 of the insulating body 21 and are fixed within the insulator 2. The first contacting portions 3111 are respectively disposed in the terminal grooves 221 of the tongue portion 22. The front side of the first contacting portion 3111 includes a first extension portion 31111, and the first extension portion 31111 is thinner than the corresponding first contacting portions 3111 and has a difference therebetween. The first extension portions 31111 are inserted into the front side of the terminal grooves 221 for fixing the first ground terminals 311. Such configuration can prevent the first contacting portion 3111 from bending while the first ground terminals 311, when connected to the opposite connector (not shown), receive external pressure. The two sides of each of the terminal grooves 221 respectively include a inclined surface for restricting the width of the front side of the terminal grooves 221, and cooperate with the width of the front side of the first contacting portions 3111. The wider structure of the first ground terminals 311 may be stopped at the inclined surfaces to prevent over-inserting when inserting the first ground terminals 311. The first main portions 3112 of the first ground terminals 311 are fixed within the slots 25 of the insulating body 21. The first tail portions 3113 extend, along the first main portions 3112, out of the insulating body 21. Also, the first tail portions 3113 may be soldered on the circuit board (not shown), and the soldering process may be a surface mount technology (SMT) process. The conducting terminals 3 may be fixed within the insulator 2 by inserting, and may also be molded on the insulator 2 by insert molding.

Figure 5:
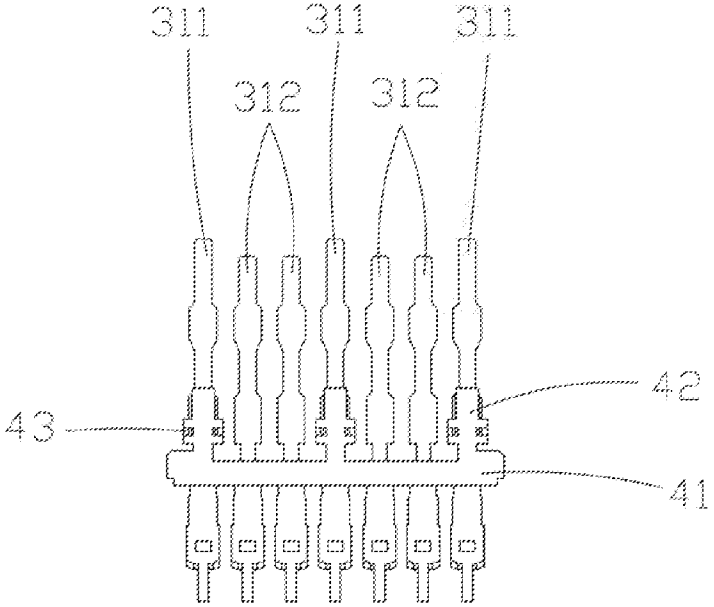
FIG. 5 is a local view of an embodiment of an electrical connector according to the present disclosure.

Referring to FIGS. 5 and 6, the first terminals 31 are formed by alternatively arranging the first ground terminals 311 and the first signal terminals 312. The arrangement includes a differential signal terminal pair and the ground terminals 311, in which the differential signal terminal pair includes one positive signal terminal and one negative signal terminal. The differential signal terminal pair is disposed between two adjacent ground terminals 311. Two differential signal terminal pairs are separated by one ground terminal 311. The arrangement is composed of a unit: ground terminal-signal terminal-signal terminal-ground terminal (G-S-S-G). Such arrangement, through the ground terminals 311, can ground the interference noise induced by the high-frequency differential signal transmitted in the signal terminals 312. Therefore, the interference between the signals of the conducting terminals 3 may be reduced. Since the second terminals 32 on the second surface 224 have substantially the same structure and arrangement as the first terminals 31, the description will not repeat again.

Figure 9:
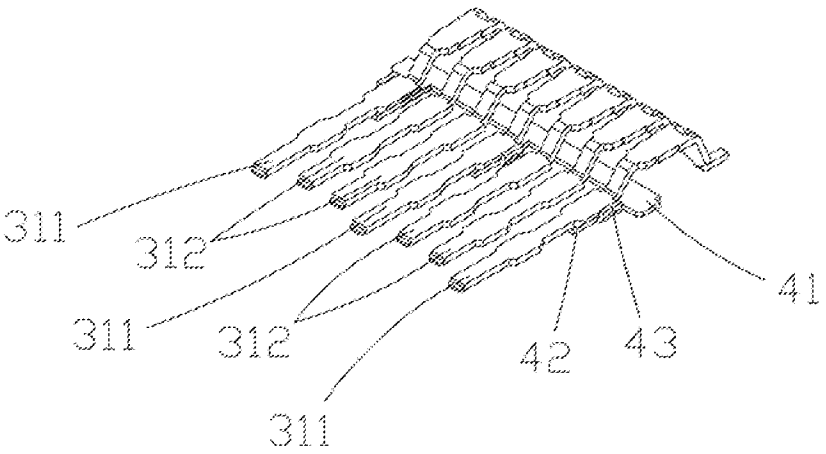
FIG. 9 is a local view of an embodiment of an electrical connector according to the present disclosure.
Figure 10:
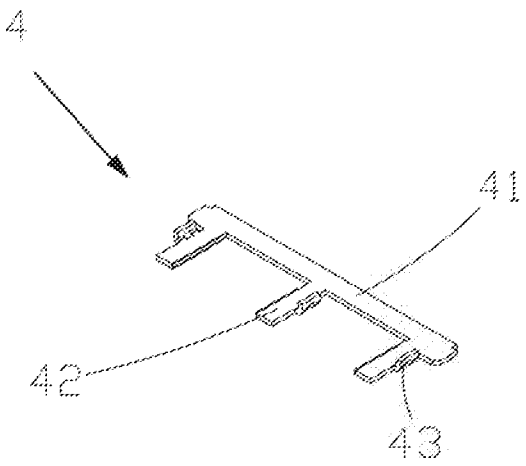
FIG. 10 is a local view of an embodiment of an electrical connector according to the present disclosure.
Figure 11:
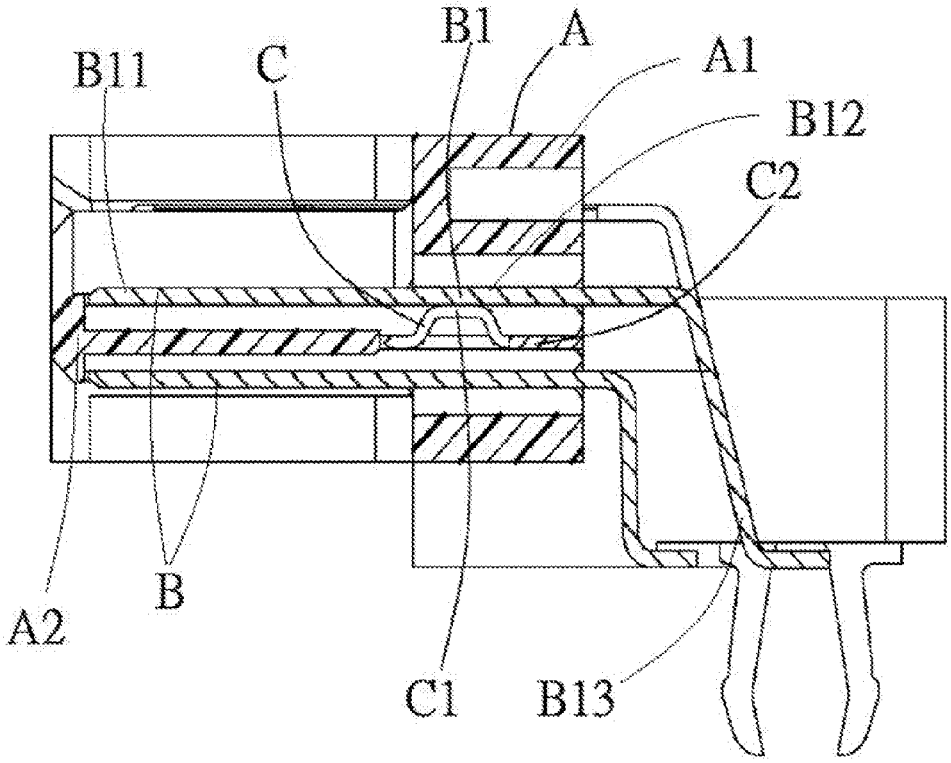
Fig. 11 ( PRIOR ART )
FIG. 11 is a schematic view of a conventional electrical connector.

In the present disclosure, referring to FIGS. 2 and 3, the ground member 4 includes a conducting body 41, and a plurality of extension portions 42, wherein the extension portions 42 extend from the conducting body 41 toward the tongue portion 22. Each of the extension portions 42 includes at least one restriction portion 43. Referring to FIGS. 7, 9, and 10, in a first embodiment, each of the extension portions 42 of the ground member 4 includes one restriction portion 43. The restriction portion 43 is bended and perpendicular to the extension portion 42, and the restriction portion 43 may be disposed on one of two longer sides of the extension portion 42. Each of the first main portions 3112 of the first ground terminals 311 is disposed in the space formed by the restriction portion 43 and each of the extension portions 42. Each of the first main portions 3112 is stacked with each of the extension portions 42 of the ground member 4, and each of the first main portions 3112 and the restriction portion 43 present on one side of the extension portions 42 interfere with each other. Therefore, the first main portions 3112, the extension portions 42, and the restriction portion 43 are electrically connected. The restriction portion 43 of the ground member 4 is placed against each of the first ground terminals 311, such that each of the restriction portion 43 of the ground member 4 and each of the first ground terminals 311 become closer and have tight contact, and further stabilize the grounding effect. The interference between the extension portions 42, the restriction portion 43, and the first main portions 3112 may increase the contact area between the ground member 4 and the first ground terminals 311, thereby increasing the conducting efficiency of grounding. The first ground terminals 311 are electrically connected to each other through the ground member 4. The ground member 4 and the first main portions 3112 are inserted into the slots 25 of the insulating body 21 and are fixed within the insulating body 21. The insulating body 21 covers the ground member 4 to prevent damage to the ground member 4. The distance between the conducting body 41 and the first tail portions 3113 is smaller than that between the extension portions 42 and the first tail portions 3113. That is, the conducting body 41, comparing to the extension portions 42, is closer to the first tail portions 3113. To prevent the conduction between the first signal terminals 312 and the conducting body 41, the first terminals 31 are designed to bypass the conducting body 41 to prevent short circuit.

Figure 8:
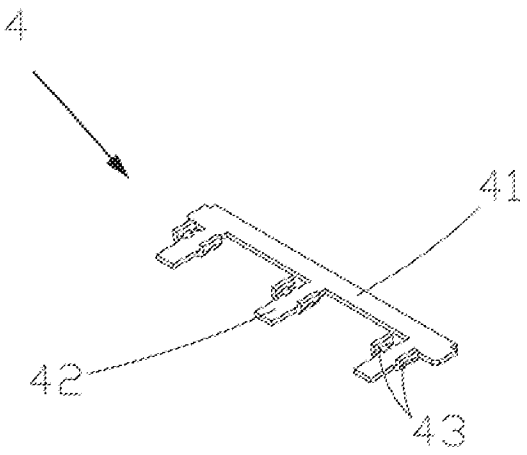
FIG. 8 is a local view of an embodiment of an electrical connector according to the present disclosure.

Referring to FIGS. 7 and 8, in a second embodiment, each of the extension portions 42 of the ground member 4 includes two opposite restriction portions 43. The restriction portions 43 are bended and perpendicular to the extension portions 42, and the restriction portions 43 may be disposed on both two longer sides of the extension portion 42. Each of the first main portions 3112 of the first ground terminals 311 is disposed in the space formed by the restriction portions 43 and each of the corresponding extension portions 42. Each of the first main portions 3112 is stacked with each of the extension portions 42 of the ground member 4, and each of the first main portions 3112 and the restriction portions 43 on the opposite sides of the extension portions 42 interfere with each other. Therefore, the first main portions 3112, the extension portions 42, and the restriction portions 43 are electrically connected. Two restriction portions 43 of the ground member 4 are placed against each of the first ground terminals 311, such that the restriction portions 43 of the ground member 4 and each of the first ground terminals 311 become closer and have tight contact, and further stabilize the grounding effect. In addition to fixing, the restriction portions 43 may also increase the contact area between the ground member 4 and the first ground terminals 311, thereby increasing the conducting efficiency of grounding. The first ground terminals 311 are electrically connected to each other through the ground member 4. The ground member 4 and the first main portions 3112 are inserted into the slots 25 of the insulating body 21 and are fixed within the insulating body 21. The insulating body 21 covers the ground member 4 to prevent damage to the ground member 4. The distance between the conducting body 41 and the first tail portions 3113 is smaller than that between the extension portions 42 and the first tail portions 3113. That is, the conducting body 41, comparing to the extension portions 42, is closer to the first tail portions 3113. To prevent the conduction between the first signal terminals 312 and the conducting body 41, the first terminals 31 are designed to bypass the conducting body 41 to prevent short circuit. The ground member 4 is fixed within the insulating body 21, and located between the first terminals 31 and the second terminals 32. The ground member 4 is contact with the first ground terminals 311 to provide a shielding between the first terminals 31 and the second terminals 32, such that the electromagnetic interference therebetween can be reduced.

The first ground terminals 311 are electrically connected to the extension portions 42 by stacking with the extension portions 42. In addition, the first ground terminals 311 further contact with the restriction portions 43. Due to the large contact area between the extension portions 42, the restriction portions 43, and the first ground terminals 311, a better electrical connection is then provided, such that the cross talk interference may be grounded rapidly. Moreover, since the restriction portions 43 on the opposite sides of the extension portions 42 are closer to the differential signal terminal pairs, the restriction portions 43 can absorb interference noise in the close distance. Therefore, the capacitive and inductive couplings of the conducting terminals 3 may be reduced, in which the capacitive and inductive couplings are induced when the differential signal terminal pairs transmit signals. Such design can reduce interference noise, increase the accuracy of high-frequency signal transmission, and further increase the efficiency of the electrical connector 1.

According to some embodiments of the disclosure, the first ground terminals 311 are connected to each other through the ground member 4. The extension portions 42 and the restriction portions 43 provide larger contact area to contact with the first ground terminals 311, and provide better electrical connection, thereby grounding the interference noise induced by the differential signal terminal pairs. Such design can reduce the problem of cross talk interference, and the electrical connector can maintain good efficiency when transmitting high-frequency signal.

The foregoing outlines features of the present disclosure so that those skilled in the art may better understand the aspects and the purpose of the present disclosure. It is noted that the above descriptions are merely preferred embodiments, and are not used to limit the scope of the present disclosure. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. An electrical connector, comprising:

an insulator, comprising an insulating body and a tongue portion, wherein the tongue portion extends from one side of the insulating body;

a plurality of conducting terminals, comprising a plurality of ground terminals and a plurality of signal terminals, wherein the ground terminals and the signal terminals are alternatively arranged, and the ground terminals and the signal terminals respectively comprise a contacting portion, a tail portion, and a main portion connecting the contacting portion to the tail portion; and a ground member, comprising a conducting body, a plurality of extension portions extending from the conducting body, wherein each of the extension portions comprises one restriction portion disposed on one side of each of the extension portions or two opposite restriction portions disposed on the opposite sides of each of the extension portions;

wherein at least part of the main portion of each of the ground terminals is stacked with each of the extension portions, each of the restriction portions of the ground member contacts the ground terminals, and each of the restriction portions of the ground member is placed against the ground terminals, such that each of the restriction portions of the ground member and the ground terminals become closer, wherein the ground member, the main portions of the ground terminals, and the main portions of the signal terminals are fixed within the insulating body, each of the tail portions extends out of the insulating body, and each of the contacting portions is disposed on a plurality of surfaces of the tongue portion;

wherein the one or two restriction portions and the corresponding main portion of each of the ground terminals interfere with each other; and wherein the distance between the conducting body and the tail portions of the conducting terminals is smaller than that between the extension portions and the tail portions of the conducting terminals.

2. The electrical connector of claim 1, wherein the extension portions extend from the conducting body toward the tongue portion.

3. The electrical connector of claim 1, wherein the insulating body comprises a plurality of slots, and the conducting terminals and the ground member are inserted into the slots and are fixed within the insulator.

4. The electrical connector of claim 1, wherein the tongue portion comprises a plurality of terminal grooves disposed on the surfaces of the tongue portion, and each of the terminal grooves accommodates each of the contacting portions of the conducting terminals.

5. The electrical connector of claim 1, wherein the ground member is present between two rows of the conducting terminals.

6. The electrical connector of claim 1, wherein at least one of the signal terminals is present between two of the ground terminals.

* * * * *